US005915470A

United States Patent [19]

Dierbeck

[11] Patent Number: 5,915,470

[45] Date of Patent: Jun. 29, 1999

[54] MODULAR HEAT EXCHANGER

[76] Inventor: Robert F. Dierbeck, 2707 Hall Rd., Hartford, Wis. 53027

[21] Appl. No.: 08/950,721

[22] Filed: Oct. 15, 1997

[51] Int. Cl.[6] ..... F28F 9/26; F28F 1/42

[52] U.S. Cl. ..... 165/144; 165/179; 165/181

[58] Field of Search ..... 165/183, 144, 165/181, 133, 179; 29/890.049

[56] References Cited

U.S. PATENT DOCUMENTS

| | | | |
|---|---|---|---|
| 1,988,224 | 1/1935 | Wendel | 165/181 X |
| 3,692,105 | 9/1972 | O'Connor | 165/181 |
| 4,059,147 | 11/1977 | Thorne | 165/133 |
| 4,195,688 | 4/1980 | Fusie et al. | 165/133 |
| 4,298,062 | 11/1981 | Pasternak | 165/181 |
| 4,554,970 | 11/1985 | Pasternak et al. | 165/181 |
| 4,565,244 | 1/1986 | O'Connor et al. | 165/181 |
| 5,146,979 | 9/1992 | Zohler | 165/133 |
| 5,303,770 | 4/1994 | Dierbeck | 165/140 |
| 5,383,517 | 1/1995 | Dierbeck | 165/144 |

FOREIGN PATENT DOCUMENTS

| | | | |
|---|---|---|---|
| 2340711 | 3/1975 | Germany | 165/181 |
| 242919 | 12/1985 | Japan | 29/890.049 |

*Primary Examiner*—Leonard Leo
*Attorney, Agent, or Firm*—Andrus, Sceales, Starke & Sawall

[57] ABSTRACT

A modular heat exchanger for a fluid flow is provided. The modular heat exchanger includes a plurality of modules formed from a heat transfer material. Each module has a generally rectangular cross section and a through bore extending longitudinally therethrough between parallel opposite faces. Each face includes a plurality of parallel fins extending fully across the face in a direction transverse to the longitudinal axis of the through bore. The fins have a generally saw tooth structure so as to increase the turbulence of the air flow through the heat exchanger.

6 Claims, 2 Drawing Sheets

FIG. 1
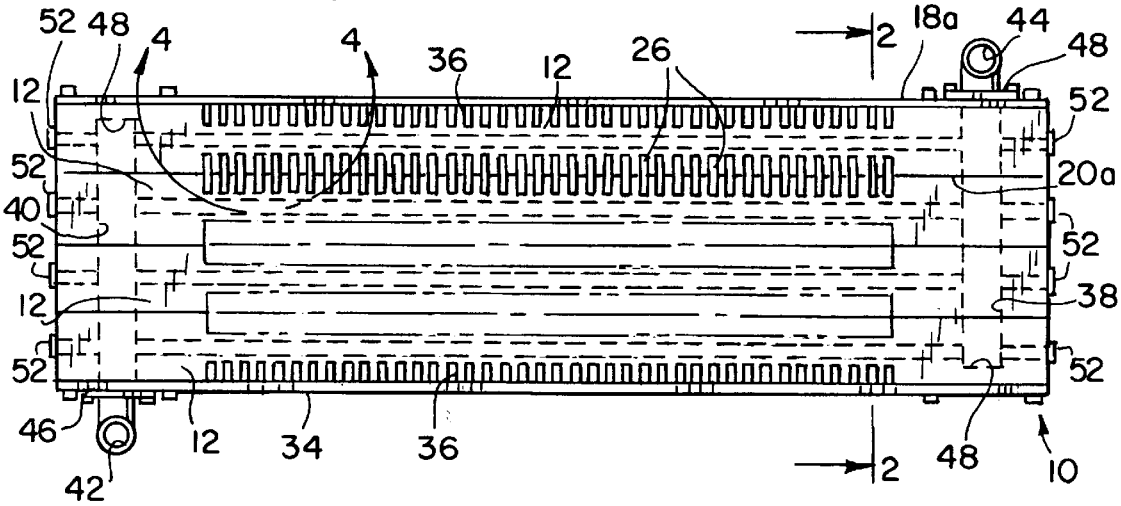
FIG. 2
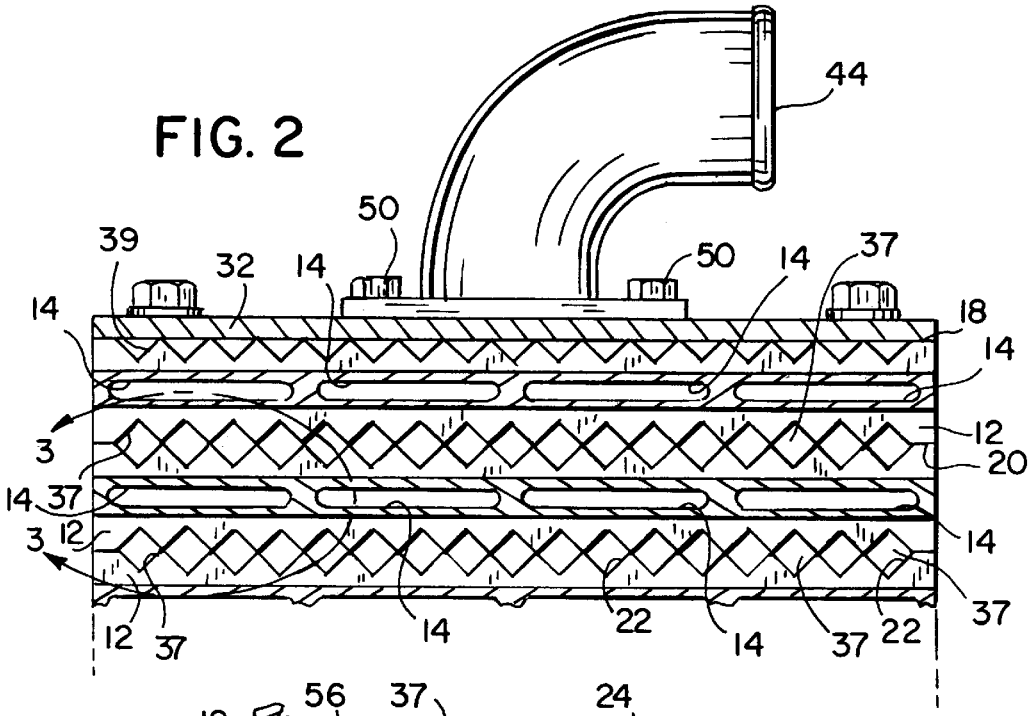
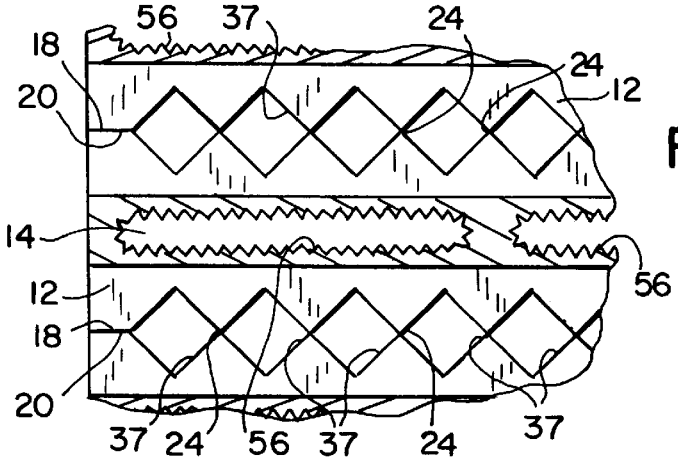
FIG. 3

MODULAR HEAT EXCHANGER

BACKGROUND AND SUMMARY OF THE PRESENT INVENTION

The present invention relates to a heat exchanger for flowing fluids and, in particular, to a modular heat exchanger wherein each of the core modules is formed from a unitary block of heat exchange material.

Typically, conventional of heat exchangers for use in automobiles utilize heat exchanging core elements which include a series of generally parallel tubular conduits extending between and attached at their opposite ends to inlet and outlet headers. The tubular conduits are provided with heat conducting and dissipating fins which may be either of a flat plate or serpentine construction, and which are soldered or brazed to the tubular conduits. The conduits, in turn, are soldered or brazed to the headers or to similar fluid accumulating tanks.

The rigid soldered or brazed joints have always constituted a common source of heat exchanger failure and, when the heat exchangers are used in automotive applications, usually require removal of the entire radiator for repair, thereby resulting in down time for the automotive equipment. Thus, there has been a long need and desire for both a heat exchanger having unitary core elements and for one in which brazed or soldered connections can be minimized and, preferably, eliminated completely.

U.S. Pat. No. 5,303,770 discloses a modular heat exchanger which includes unitary finned tubular core elements which can be assembled into a multi-module heat exchanger, including flow distributing headers or end tanks without brazed, soldered, or welded connections of any kind. The heat exchanger is fully disassemblable in one embodiment, however, mechanical connectors and a substantial number of o-ring seals are required for assembly. In another embodiment, welded or brazed connections may be utilized to provide units which are partially disassemblable. However, these units are potentially subject to the prior art problems of inadequate joint strength and environmentally less desirable materials.

U.S. Pat. No. 5,383,517 discloses a modular heat exchanger having unitary finned tubular core elements which can be assembled into a multi-modular heat exchanger without any brazed, soldered or welded connections or mechanical connectors. The modules are formed from extruded aluminum blocks into which heat exchanging fins are cut or cold formed. Flow accumulating passages are bored into the ends of the modules. The modules are assembled with a high strength adhesive sealant which simultaneously secures the modules together and seals the peripheries of the bore passages at the module interfaces. However, it has been found during certain applications, increased heat dissipation by the heat exchanging fins is necessary.

Therefore, as a primary object and feature of the present invention to provide a modular heat exchanger which may be assembled without any brazed, soldered or welded connections or mechanical connectors.

It is a further object and feature of the present invention to provide a modular heat exchanger with increased heat dissipating ability.

It is a still further object and feature of the present invention to provide a modular heat exchanger wherein the modules may be formed from extruded aluminum blocks in to which the heat exchanging fins are cut or cold formed.

In accordance with the present invention, a modular heat exchanger is provided for a fluid flow. The modular heat exchanger a plurality of modules formed from heat transfer material. Each module has a generally rectangular cross section and a through bore extending longitudinally therethrough between parallel opposite faces. Each face includes a first set of equally spaced slots extending fully across the face in a direction transverse to the longitudinal axis of the through bore so as to define a series of parallel fins. Each face also includes a second set of equally spaced, parallel slots extending fully across the face in a direction parallel to the longitudinal axis of the bore. Each parallel fin includes a plurality of outer edges. A portion of the outer edges of the fins of a module abuts the outer edge of the fins on an adjacent module when the modules are placed together in face-to-face contact.

It is contemplated that each of the second set of equally spaced, parallel slots have a generally V-shaped cross section. This, in turn, causes each fin to include a set of equally spaced, generally triangular teeth extending across the face in a direction transverse to the longitudinal axis of the through bore. In order to increase the turbulence of the air flowing through the modular heat exchanger of the present invention, each tooth of each fin may be bent at a predetermined angle to the longitudinal axis of the through bore.

If the teeth are not bent, the first set of equally spaced slots has a generally rectangular cross section. The depth of the first set of equally spaced slots is greater than the depth of the second set of equally spaced, parallel slots having the generally V-shaped cross section.

It is further contemplated to provide a cross bore perpendicular to and passing through abutting faces of the modules and intersecting the through bores at each end of the module. The through bores are oblong in cross section and include a plurality of ribs extending along their inner surface.

In an alternate embodiment, a modular heat exchanger is provided for a fluid flow. The modular heat exchanger includes a plurality of modules formed from heat transfer material. Each module has a generally rectangular cross section and through bore extending longitudinally therethrough between parallel opposite faces.

A plurality of equally spaced fins extend across each face of a corresponding module in a direction transverse to the longitudinal axis of the through bore. Each fin includes a plurality of spaced teeth terminating at an outer edge. A portion of the outer edge of each tooth on a corresponding face of the module abuts the outer edge of a tooth on an adjacent module when the modules are placed together in face-to-face contact.

In accordance with the present invention, a module is provided for use in a modular heat exchanger. The module includes a generally rectangular element formed from a heat transfer material. The element has a generally rectangular cross section and a through bore extending longitudinally therethrough between parallel opposite faces. Each face includes a set of equally spaced parallel slots having a generally V-shaped cross section extending fully across the face in a direction parallel to the longitudinal axis of the through bore.

It is further contemplated to provide each face with a second set of equally spaced slots extending fully across the face in a direction transverse to the longitudinal axis of the through bore so as to define a series of parallel fins along each face.

As previously described, the through bores are oblong in cross section and defined by an inner surface of the module.

A plurality of ribs extends along the inner surface of the module for the full length of the through bore.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings:

FIG. 1 is a front elevational view of a heat exchanger using the modular construction of the present invention;

FIG. 2 is a cross-sectional view taken along line 2—2 of FIG. 1;

FIG. 3 is an enlarged sectional view taken along line 3—3 of FIG. 2;

DETAILED DESCRIPTION OF THE PREFERRED EMBODIMENT

Figure 4:
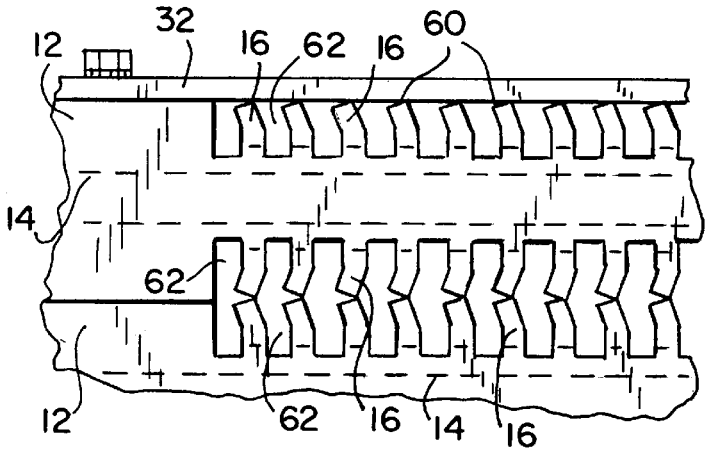
FIG. 4 is an enlarged sectional view taken along line 4—4 of FIG. 1 showing the heat exchanger of the present invention incorporating a second embodiment of a heat exchanger module.

Referring to FIG. 1, a heat exchanger in accordance with the present invention is generally designated by the reference numeral 10. Heat exchanger 10 includes a series of identical core modules 12 which, in the heat exchanger shown, comprise four in number. Each module 12 is preferably made from an elongated extruded aluminum block which is generally rectangular in cross section and is formed in an extrusion process with a series of four parallel through bores 14 having flattened or oval cross sections.

A series of parallel fins 16 is formed on each of the opposite faces 18 and 20 of module 12 to overlay the series of through bores 14. The fins 16 are formed so as to extend generally transverse to the axis of the through bores 14.

Figure 5:
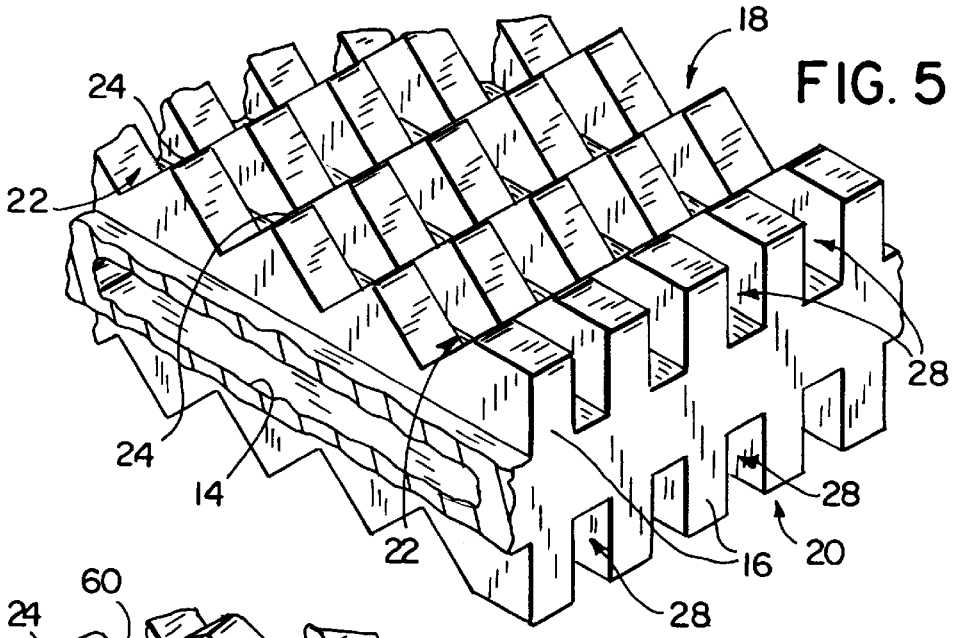
FIG. 5 is an isometric view, partially in section, showing portions of a heat exchanger module for use with the heat exchanger of the present invention.

As best seen in FIGS. 2–3 and 5, a series of parallel, V-shaped channels 22 are also formed on each of the opposite faces 18 and 20 of module 12 to overlay the series of through bores 14. The V-shaped channels 22 are formed to extend generally parallel to the axis of the through bores 14 such that fins 16 are provided with a generally saw tooth shape. The V-shaped channels 22 formed in modules 12 provide each fin 16 with additional surface area for enhanced heat transfer. In addition, the V-shaped channels 22 and modules 12 allow for increased air flow through heat exchanger 10 and increase the turbulence of the air flowing therethrough in order to effectuate enhanced heat transfer. The outer edges 24 of each fin 16 lie coplanar with the corresponding planes 18 and 20 in which the fin is formed.

Heat exchanger 10 is formed by stacking the four modules 12 together in face-to-face contact such that the outer edges 24 of each fin 16 engage and abut the outer edges 24 of an adjacent module 12. As best seen in FIG. 1, the modules 12 in the assembled heat exchanger 10 define interior air flow passages 26 between adjacent modules which are two times the height of fins 16 and as wide as slots 28 between adjacent fins.

The heat exchanger 10 is enclosed between a pair of outer mounting plates 32 and 34 which abut corresponding outer edges 24 of the fins 16 on the outside faces of the outer modules 12 to define a series of outer air flow passages 36. As seen in FIG. 1, outer air flow passages 36 are approximately one/half the height of interior air flow passages 26 and as wide as slots 28 between adjacent fins.

Referring to FIG. 2, the modules 12 in the assembled heat exchanger 10 also define an interior cross air flow passages 37 between adjacent modules. The inner cross air flow passages 37 have a generally diamond shaped cross section having a height which is less than the height of the interior air flow passages 26.

The outer plates 32 and 34 which abut corresponding outer edges 24 of fins 16 on the outside faces of the outer modules 12 also define a series of outer cross air flow passages 39. As best seen in FIG. 2, outer cross air flow passages 39 are approximately one-half the height of interior cross air flow passages 37.

The opposite ends of each face 18 and 20 of each module 12 include corresponding flat face portions 18*a* and 20*a*, respectively, in which no fins are provided. In order to assemble heat exchanger 10, the face portions 18*a* and 20*a* are covered with a layer of a suitable high strength adhesive to secure the modules together such that the outer edges 24 of each fin 16 engage and abut the outer edges 24 of an adjacent module 12. Similarly, the face portions 18*a* and 20*a* of the outer modules are adhesively secured to the abutting surfaces of the corresponding mounting plates 32 and 34, respectively, to complete the assembly.

First and second cross bores 38 and 40 extend through the face portions 18*a* and 20*a* in a direction generally perpendicular to the axis of the through bores 14. As best seen in FIG. 1, each cross bore 38 and 40 is positioned on opposite sides of heat exchanger 10 and is dimensioned to intersect all four through bores 14 in each module 12. As described, cross bores 38 and 40 allow for the flow of fluid between the inlet end 42 and the outlet end 44 of heat exchanger 10.

In order to prevent leakage of the fluid flowing through heat exchanger 10, the interfaces between adjacent face portions 18*a* and 20*a* and cross bores 38 and 40 passing therethrough are sealed about their peripheries by an adhesive layer used to attach and secure the modules 12 together, respectively, as heretofore described. Inlet and outlet ends 42 and 44 of each exchanger 10 are provided with a corresponding flanged connecting plate 46 and 48, respectively. Each flanged connecting plate 46 and 48 is attached to the outside surface of a corresponding mounting plate 34 and 32, respectively, as with bolts 50. In its assembled position, inlet end 42 is in fluid communication with cross bore 40 via an opening in mounting plate 34, and outlet end 44 is in fluid communication with cross bore 38 via an opening in mounting plate 32.

Each cross bore 38 and 40 is provided as a blind cross bore by providing one end face of each outer module 12 with a blind cross bore portion 48. Similarly, the ends of all the through bores 14 on the ends of heat exchanger 10 must be plugged, as shown in FIG. 1. The plugs 52 may comprise permanent welds, elastomer plugs, or preferably aluminum plugs secured in place within an adhesive.

Various types of adhesive seal materials may be utilized to secure the modules together, and also to provide other adhesive joints or seals, such as to secure the plugs 52 in place. Various types of adhesive seal materials are more fully described in U.S. Pat. No. 5,383,517 to the inventor of the present invention, and incorporated herein by reference.

Referring to FIG. 3, the through bores 14 may be provided with a plurality of longitudinally extending ribs 56. Ribs 56 provide each through bore 14 with additional surface area for enhanced heat transfer.

Figure 6:
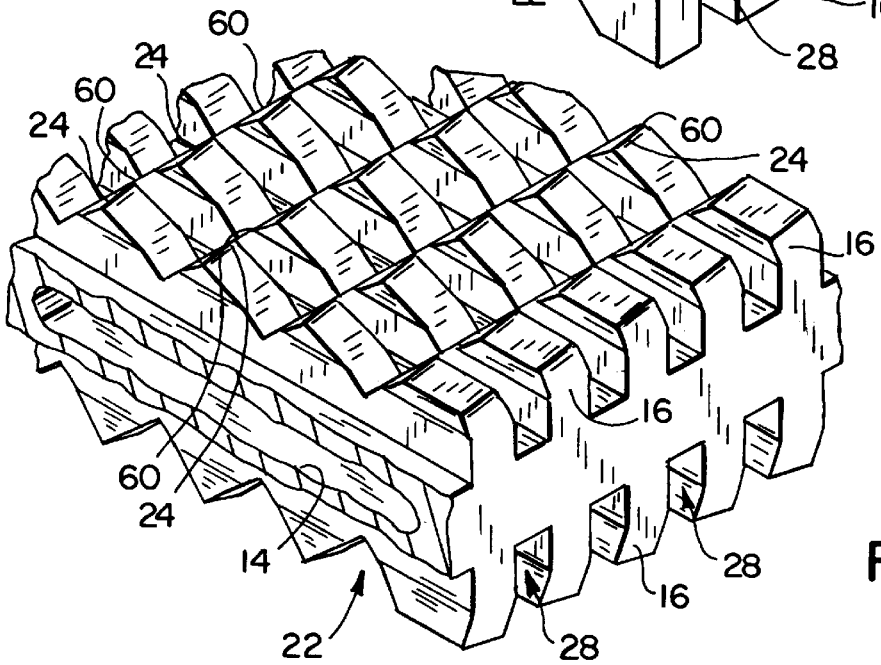
FIG. 6 is an isometric view, partially in section, showing the second embodiment of a heat exchanger module for use in the head exchanger of the present invention.

Referring to FIGS. 4 and 6, it is highly desirable to increase the turbulence of the air flowing through heat exchanger 10 in order to improve the heat exchange capability thereof. In order to increase the turbulence of the air flowing through heat exchanger 10, it is contemplated to modify each core module by bending or skewing the fins 16 thereof. The exchanger depicted in FIG. 4 and the core module depicted in FIG. 6 are identical to those previously described but for the bending and/or skewing of the fins, and hence, the previous description of the heat exchanger 10 described in detail will be understood to describe the heat exchanger shown in FIG. 4, with common reference characters being used.

In order to bend or skew fins 16, a fin deformation tool engages the outer edges 24 of each fin 16 thereby causing the bend or skew. As a result, the apex 60 of each outer edge 24 of each fin 16 lies coplanar with the corresponding planes 18 and 20 in which the fins 16 are formed. The heat exchanger of FIG. 4 is formed by stacking modules 12 together in face-to-face contact such that the apex 60 of each outer edge 24 of each fin 16 engages and abuts a corresponding apex of each outer edge 24 of an adjacent module 12. As best seen in FIG. 4, modules 12 in assembled heat exchanger 10 define skewed interior air flow passages 62 between adjacent modules in order to increase the turbulence of the air flowing therepast and effectuate enhanced heat transfer.

It is contemplated as being within the scope of the present invention to skew or bend each fin 16 in such a manner that a first outer edge 24 slants from its corresponding apex in an opposite direction to the slant of an adjacent outer edge 24 on the same fin.

Various modes of carrying out the invention are contemplated as being within the scope of the following claims particularly pointing out and distinctly claiming the subject matter which is regarded as the invention.

I claim:

1. A modular heat exchanger for a fluid flow, comprising:

a plurality of modules formed from heat transfer material, each module having a generally rectangular cross section and a through bore extending longitudinally along an axis therethrough between parallel opposite faces;

each face including a set of equally spaced slots extending fully across the face in the direction transverse to the longitudinal axis of the through bore so as to define a series of parallel planar fins, and including a set of equally spaced, parallel channels extending fully along the face in a direction parallel to the longitudinal axis of the bore, said channels defining in each parallel fin a plurality of spaced, generally triangular teeth said teeth defining fin outer edges, a portion of the outer edges of the fins of a module abutting the outer edges of the fins on an adjacent module when the modules are placed together in face-to-face contact to define air flow passages; and, each of said teeth having a bent portion displaced at least partially from the plane of the fin to protrude into the adjacent air flow passage to create air flow turbulence.

2. The modular heat exchanger of claim 1 wherein each of the equally spaced, parallel channels has a generally V-shaped cross-section.

3. The modular heat exchanger of claim 1 further comprising a cross bore perpendicular to and passing through abutting faces of the modules and intersecting the through bores at each end of the modules.

4. The modular heat exchanger of claim 1 wherein the through bores are oblong in cross section.

5. The modular heat exchanger of claim 1 wherein each slot extending across the face in direction transverse to a longitudinal axis has a generally rectangular cross section.

6. The modular heat exchanger as set forth in claim 1 wherein:

said teeth have a depth less than the depth of the slots such that each fin includes a continuous planar base interconnecting and supporting the teeth.

* * * * *